US011051102B2

(12) United States Patent
Fuller et al.

(10) Patent No.: US 11,051,102 B2
(45) Date of Patent: Jun. 29, 2021

(54) VARIABLE SHAPE SURROUND DEVICE FOR A HIGH EXCURSION SPEAKER DRIVE

(71) Applicants: Jacob Aaron Fuller, Claremont, NC (US); Murilo Kulczynski Alvares, Mont-St-Hilaire (CA)

(72) Inventors: Jacob Aaron Fuller, Claremont, NC (US); Murilo Kulczynski Alvares, Mont-St-Hilaire (CA)

( * ) Notice: Subject to any disclaimer, the term of this patent is extended or adjusted under 35 U.S.C. 154(b) by 0 days.

(21) Appl. No.: 15/899,690

(22) Filed: Feb. 20, 2018

(65) Prior Publication Data

US 2018/0242084 A1 Aug. 23, 2018

Related U.S. Application Data

(60) Provisional application No. 62/460,991, filed on Feb. 20, 2017.

(51) Int. Cl.
*H04R 5/02* (2006.01)
*H04R 1/02* (2006.01)
*H04R 7/20* (2006.01)

(52) U.S. Cl.
CPC ..... *H04R 5/02* (2013.01); *H04R 1/02* (2013.01); *H04R 7/20* (2013.01); *H04R 2207/021* (2013.01)

(58) Field of Classification Search
CPC ..... H04R 7/16–24; H04R 31/006; H04R 2307/207; H04R 2231/001
See application file for complete search history.

(56) References Cited

U.S. PATENT DOCUMENTS

| | | | | |
|---|---|---|---|---|
| 7,218,748 | B1 * | 5/2007 | Stompler | H04R 7/18 181/172 |
| 9,961,448 | B2 * | 5/2018 | Huang | H04R 9/06 |
| 2005/0185816 | A1 * | 8/2005 | Roark | H04R 9/06 381/400 |
| 2007/0127765 | A1 * | 6/2007 | Chan | H04R 31/006 381/396 |

FOREIGN PATENT DOCUMENTS

| | | | | |
|---|---|---|---|---|
| WO | WO 2015110038 | A1 * | 7/2015 | H04R 7/16 |

* cited by examiner

*Primary Examiner* — Mark Fischer
(74) *Attorney, Agent, or Firm* — Nexsen Pruet, PLLC; Seth Hudson

(57) ABSTRACT

The present invention provides methods and systems for a surround device that includes a generally circular arcuate portion that contains a first side and a second side, a first planar portion extends from the first side and a second planar portion extends from the second side, a plurality of outwardly facing ribs are disposed on the first side, and a plurality of inwardly facing ribs are disposed on the second side.

18 Claims, 6 Drawing Sheets

VARIABLE SHAPE SURROUND DEVICE FOR A HIGH EXCURSION SPEAKER DRIVE

CROSS REFERENCE TO RELATED PATENT APPLICATION

The present patent application/patent claims the benefit of priority of U.S. Provisional Patent Application No. 62/460,991, filed on Feb. 20, 2017, and entitled "Variable Shape Surround For A High Excursion Speaker Drive," the contents of which are incorporated in full by reference herein.

FIELD OF THE INVENTION

The present invention relates generally to a generally circular surround for an increased stiffening effect, and more generally relates to a generally circular surround that contains a plurality of ribs disposed on the surround for increasing the stiffening effect towards the displacement limits.

BRIEF SUMMARY OF THE INVENTION

According to an embodiment of the present invention, a surround device that includes a generally circular arcuate portion that contains a first side and a second side, a first planar portion extends from the first side and a second planar portion extends from the second side, a plurality of outwardly facing ribs are disposed on the first side, and a plurality of inwardly facing ribs are disposed on the second side.

According to another embodiment of the present invention, the surround device includes a center portion of the arcuate portion that does not contain any ribs for creating a linear displacement range.

According to yet another embodiment of the present invention, the surround device is composed of Santoprene.

According to yet another embodiment of the present invention, the surround device has ribs with a length of between about 70 mm and about 1 mm and a width between about 40 mm and about 1 mm.

According to yet another embodiment of the present invention, the surround device has ribs with a length of between about 50 mm and about 10 mm and a width of between about 20 mm and about 5 mm.

According to yet another embodiment of the present invention, the surround device has ribs with a length of between about 30 mm to about 20 mm and a width of about 15 mm to about 10 mm.

According to yet another embodiment of the present invention, the surround device has a first planar portion that extends outwardly and forms an angle between an exterior surface of the first planar portion and an exterior surface of the first side of about 90° to about 120°.

According to yet another embodiment of the present invention, the surround device has a second planar portion that extends outwardly and forms an angle between an interior surface of the second planar portion and a plane extending horizontally under the surround device of about 95° to about 150°.

According to yet another embodiment of the present invention, the surround device has a top portion, a first side extending downwardly from the top portion, a second side extending downwardly from the top portion and opposite the direction of the first side, and a trough formed between the first side, the second side, and the top portion. A first planar portion extends outwardly from the first side to an outer edge and a second planar portion extends outwardly from the second side to an outer edge. A plurality of outwardly facing ribs is disposed along the first side and a plurality of inwardly facing ribs is disposed along the second side.

According to yet another embodiment of the present invention, the surround device includes outwardly spacing ribs are spaced-apart an equal distance along an exterior of the first side.

According to yet another embodiment of the present invention, the surround device includes inwardly facing ribs are spaced-apart an equal distance along the exterior side of the second side.

According to yet another embodiment of the present invention, the surround device includes outwardly facing ribs have a front side and a back side and the width of the outwardly facing rib decreases along the length of the outwardly facing rib from the front side to the back side.

According to yet another embodiment of the present invention, the surround device includes inwardly facing ribs have a front side and a back side and the width of the inwardly facing rib gradually increases along the length from the front side to a central portion of the inwardly facing rib and then gradually decreases along the length from the central portion to the back side.

According to yet another embodiment of the present invention, the surround device is generally circular and the center of the surround device is a void.

According to yet another embodiment of the present invention, the surround device includes a top portion, a first side extending downwardly from the top portion and having an interior side and an exterior side, and a second side extending downwardly from the top portion and opposite the direction of the first side and having an interior side and an exterior side. A trough is formed within the interior of the first side, the second side, and the top portion. A first planar portion extends outwardly from the first side to an outer edge, and a second planar portion extends outwardly from the second side to an outer edge. A plurality of outwardly facing ribs are disposed along the first side, and a plurality of inwardly facing ribs disposed on along the second side.

According to yet another embodiment of the present invention, the surround device includes an outwardly facing rib disposed on the first planar portion.

According to yet another embodiment of the present invention, the surround device includes an outwardly facing rib with a width of between about 12 mm to about 14 mm.

According to yet another embodiment of the present invention, the surround device includes a inwardly facing rib that has a width of between about 12 mm to about 15 mm.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
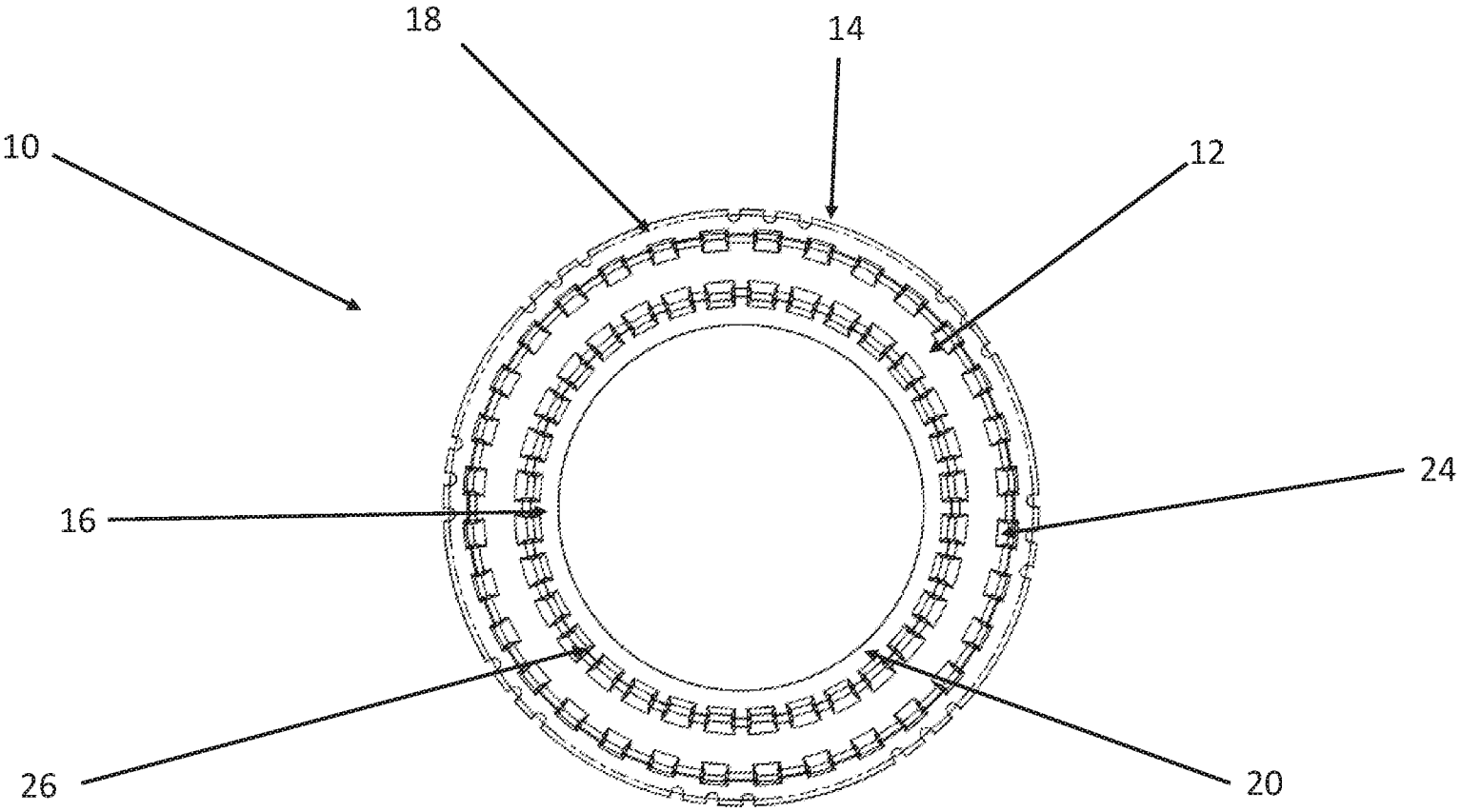
FIG. 1 is a top view of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Referring now specifically to the drawings, a surround device is illustrated in FIGS. 1-5 and is shown generally at reference numeral 10. The surround device 10 has a three-dimensional shape to provide an increased stiffening effect towards the displacement limits while maintaining linear force/displacement behavior during low and medium amplitude displacement. The 3D shape also allows for or has the additional effect of reduced instability due to buckling effect on large displacement.

The surround device 10 is generally circular and contains a void in the center. In other words, the center portion of the surround device 10 has a hollow center portion that does not contain any portion of the surround device 10. The surround device 10 contains a generally arcuate center portion 12 having a first side 14 and a second side 16 that extends downward from opposite directions to a first planar portion 18 and a second planar portion 20. The arcuate center portion 12 contains an exterior surface and an interior surface. The surround device 10 has a top portion with a first side 14 that extends downward from one direction and a second side 16 that extends downward from the opposite direction forming a trough 22 with the interior surface of the top portion and first side 14 and second side 16. The first planar portion 18 extends outwardly from the first side 14 to an outer edge, and the second planar portion 20 extends outwardly from the second side 16 to an outer edge. A plurality of outwardly facing ribs 24 and a plurality of inwardly facing ribs 26 are positioned along the exterior surface of the first side 14 and the second side 16 of the arcuate center portion 12 to provide the desired effect of the surround 10. The inwardly facing ribs 26 face towards the void or center 2 of the surround device 10. The outwardly facing ribs 24 face outwards to the exterior area around the surround device 10.

The profile of the surround device 10 is generally arcuate shaped or having an axis of symmetrical shape that can be in the shape of a segment of a circle or any other, including accordion-shaped wave, elliptical, "tall-roll" or any shape that allows for symmetrical movement on a direction while restraining movement on the orthogonal directions. The top portion of the arcuate center portion 12, or the area where the upper portion of the first side 14 and the second side 16 intersect or become one, is free of ribs for creating the linear displacement range.

Figure 2:
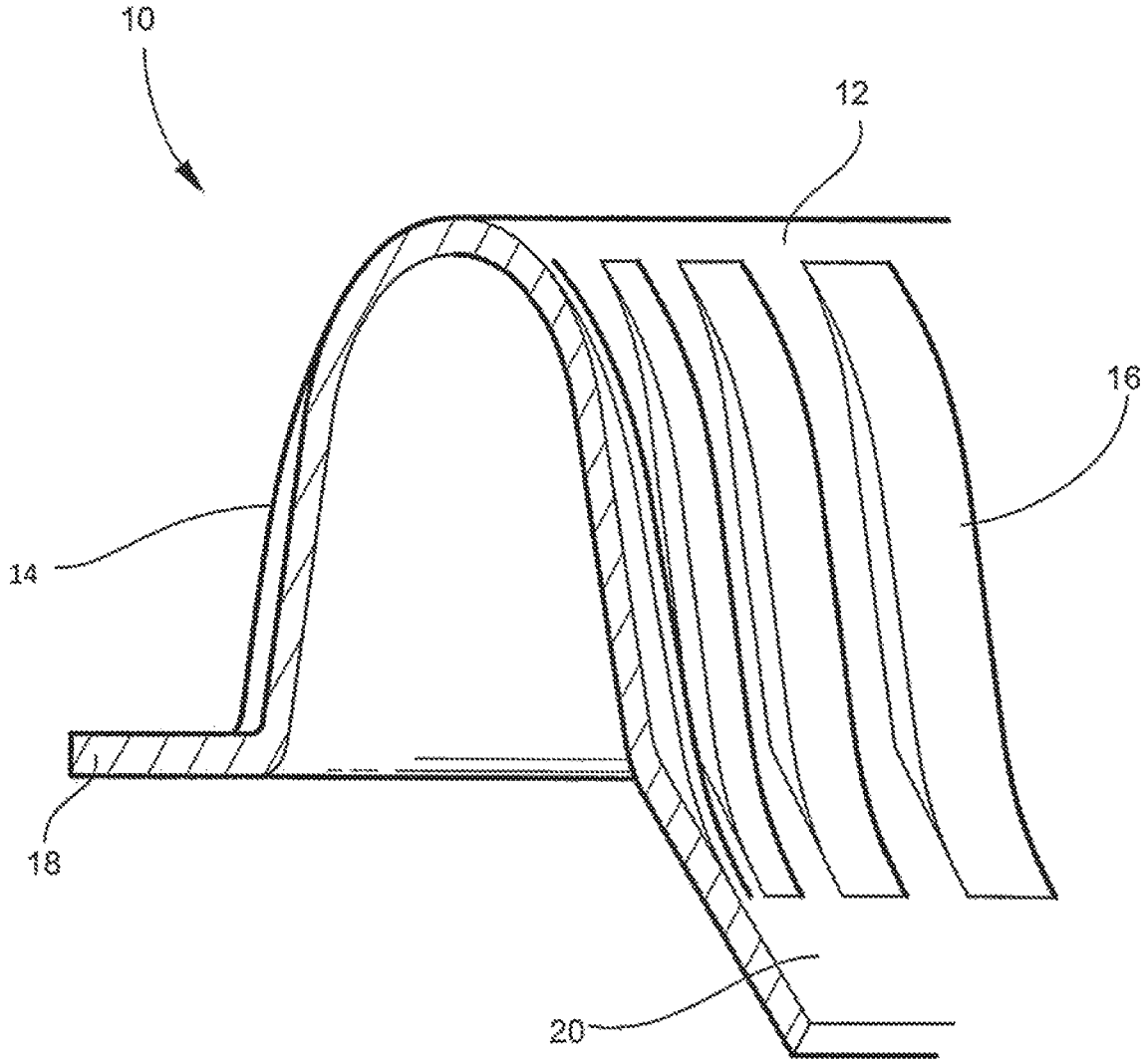
FIG. 2 is a cross-section of the surround of the present invention along the line A-A- of FIG. 1.
Figure 3:
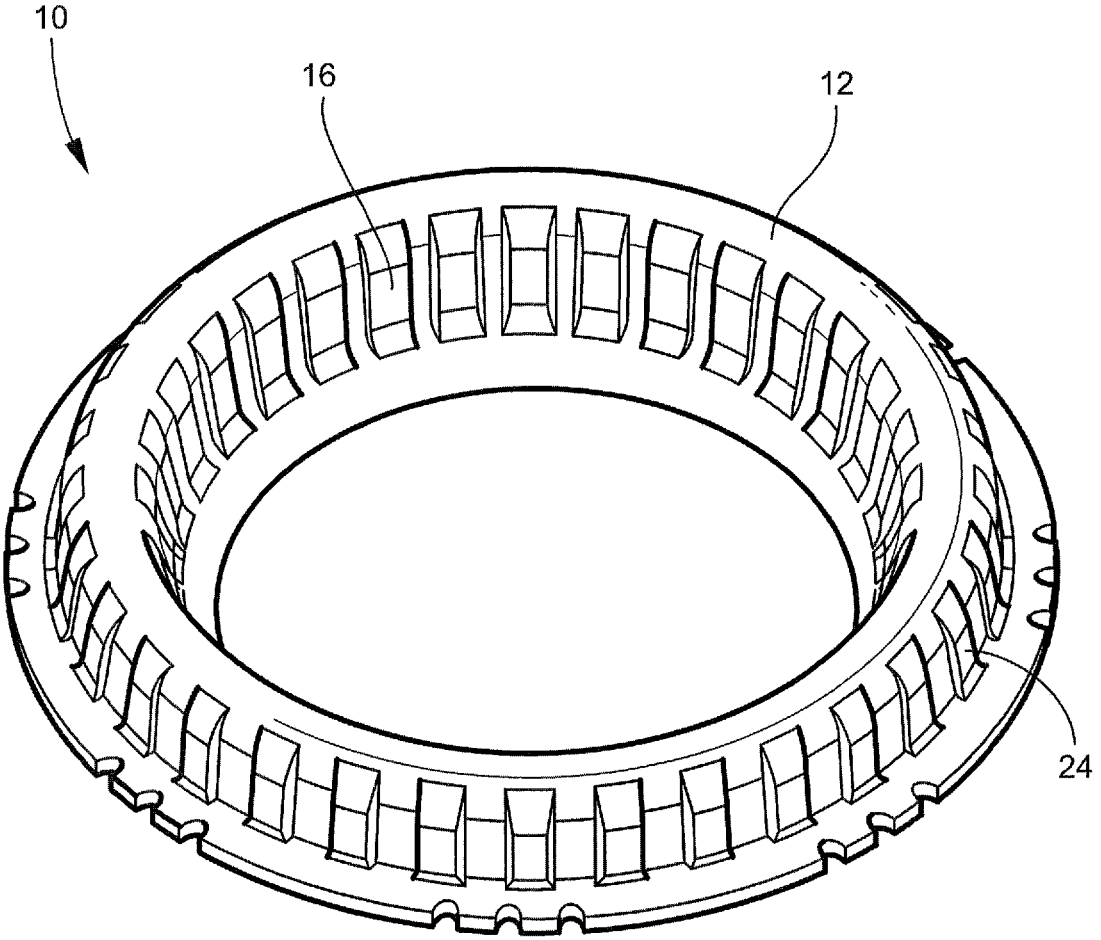
FIG. 3 is a perspective view of the present invention.
Figure 4:
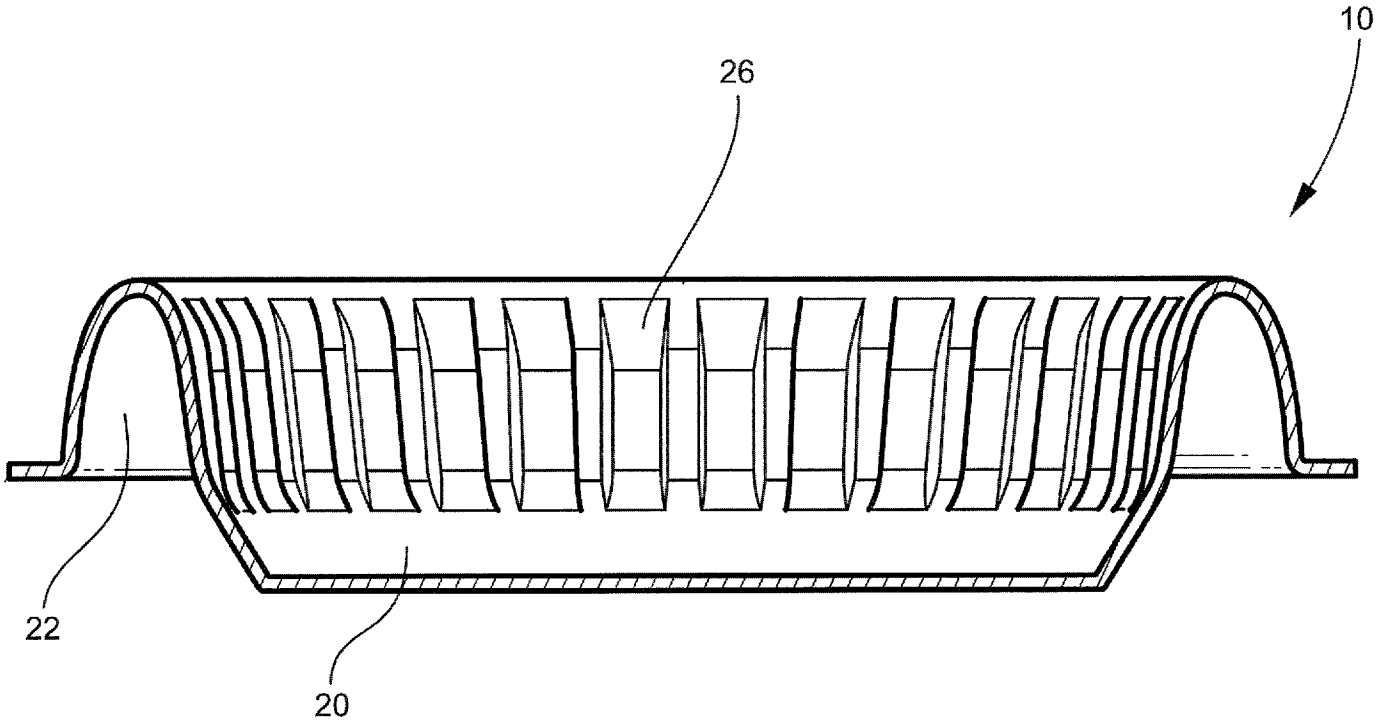
FIG. 4 is a side view of the present invention.

The outwardly facing ribs 24 have a front side, a back side, a left side, and a right side. The front side is positioned adjacent the first planar portion 18 and extends upwards along the first side 14 to the arcuate center portion 12 to the back side. The height of the rib 24 decreases from the front side to the back side of the outwardly facing rib 24. The decrease in height is gradual along the length of the rib 18 having the greatest height at the front side and decreasing to zero or no height at the back side, as shown in FIG. 2. The outwardly facing ribs 24 generally have a rectangularly shape. A plurality of outwardly facing ribs 24 are spaced around the entire surround device 10 in a spaced-apart arrangement.

The inwardly facing rib 26 has a different configuration than that of the outwardly facing rib 24. Like the outwardly facing rib 24, the inwardly facing rib 26 has a front side, a back side, a left side, and a right side. The front side is positioned adjacent the second planar portion 20 and extends upwards to the arcuate center portion 12 to the back side of the inwardly facing rib 26. The height of the inwardly facing rib 26 is greatest in its central portion disposed between the front side and the back side. The height gradually increases along the length of the rib from the front side, stays constant towards the center portion of the inwardly facing rib 26, and gradually decreases towards the back end to zero or no height. The inwardly facing ribs generally have a rectangularly shape. A plurality of inwardly facing ribs 26 are spaced around the entire surround device 10 in a spaced-apart arrangement. The first side of the inwardly facing rib 26 is positioned on the second planar portion 20 and extends onto the second side 16 along the length of the inwardly facing rib 26 to the back side that is disposed on the second side 16 of the surround device 10, as illustrated in FIG. 2.

During production, the surround device 10 may be injection molded or formed from any other known method. Preferably, the surround device 10 is composed of Santoprene, but can be composed of any other rubber or thermoplastic elastomer material.

The length of the ribs (24,26) may have a length of between about 70 mm and about 1 mm and a height between about 40 mm and about 1 mm, more preferably a length of between about 50 mm and about 10 mm and a height of between about 20 mm and about 5 mm, and most preferably a length of between about 30 mm to about 20 mm and a height of about 15 mm to about 10 mm, including all points in-between.

The surround device 10 has a thickness between about 0.1 mm to about 4 mm and preferably from about 0.5 mm to about 2.5 mm at the locations that do not contain ribs (24,26).

Figure 5:
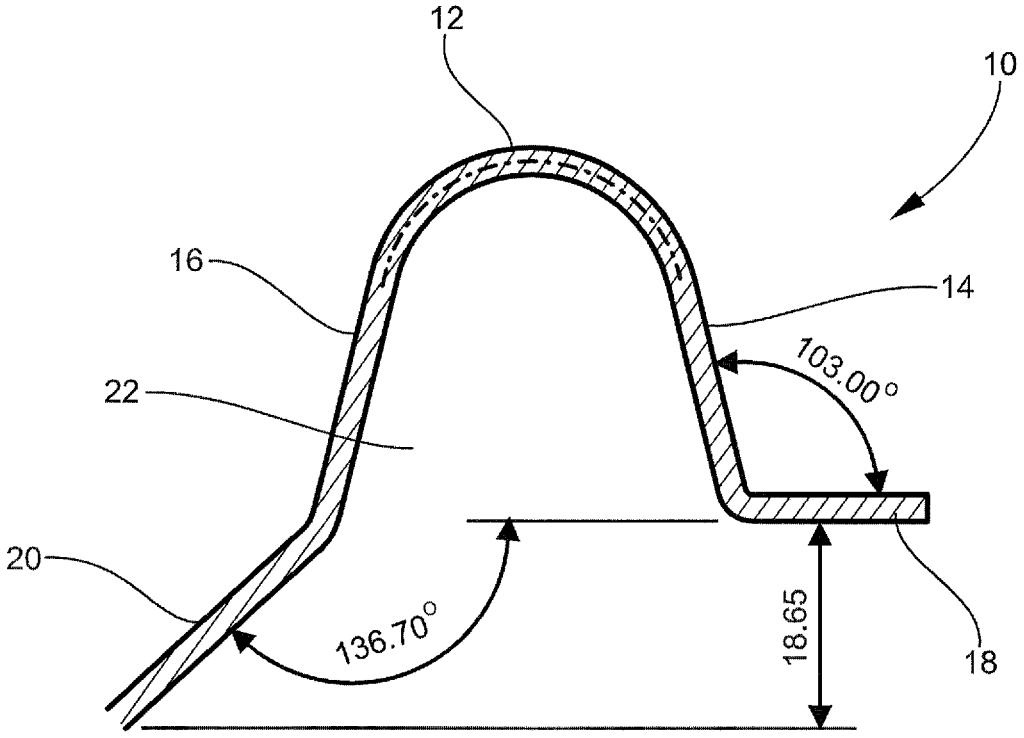
FIG. 5 is a cut-away side view of the present invention.
Figure 6:
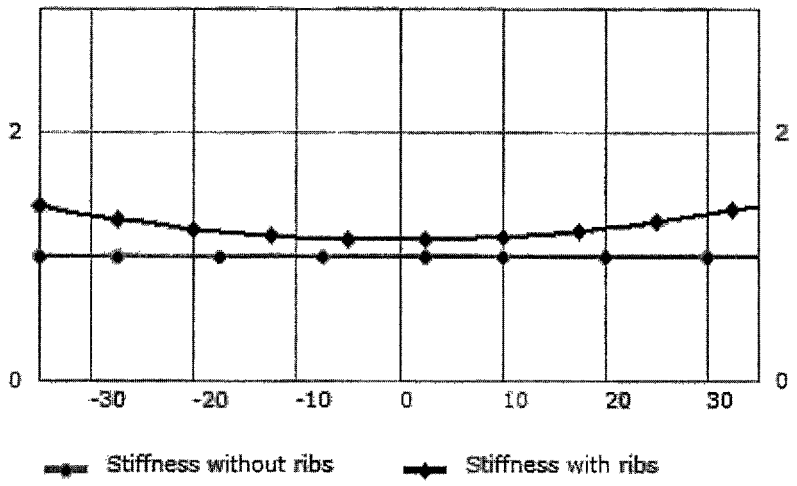
FIG. 6 is a table showing the effect of a surround with ribs and without ribs.

The first planar portion 18 extends outwardly from a first end of the first side 14. The first planar portion 18 extends outwardly and forms an angle between the exterior surface of the first planar portion 18 and the exterior surface of the first side 14 of about 90° to about 120°, and more preferably between about 95° and about 110°, and most preferably an angle of 103°. The second planar portion 20 extends outwardly from a first end of the second side 16. The second planar portion 20 extends outwardly and forms an angle between the interior surface of the second planar portion 20 and a plane extending horizontally under the surround device 10, as shown in FIG. 5 of about 95° to about 150° and preferably from about 125° to about 140°, and most preferably an angle of 136.7°.

The outwardly facing rib 24 has a width of about 10 mm to about 17 mm, and preferably from about 12 mm to about 14 mm, and most preferably from about 12 mm to about 14 mm. The inwardly facing rib 26 has a width of about 10 mm to about 18 mm, and preferably between about 12 mm to about 17 mm, and most preferably from about 13 mm to about 15 mm.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A surround device of a speaker comprising:

a generally circular arcuate portion that contains a top portion and a first side that extends downwardly from the top portion and a second side that extends downwardly from the top portion opposite the direction of the first side, the first side includes an exterior surface and an interior surface and the second side includes an exterior surface and an interior surface, a trough is formed within the top portion, the interior surface of the first side, and the interior surface of the second side;

a first planar portion extends from the first side to an outer edge and contains at least one grouping of notches, wherein each grouping of the at least one grouping consists of three spaced-apart notches, within the outer edge, and a second planar portion extends from the second side;

a plurality of outwardly facing ribs positioned on the exterior surface of the first side having a rectangular shape and a front side and a back side, the front side adjacent the first planar portion, the height of the plurality of outwardly facing ribs decreases from the front side to the back side, the decrease in height is gradual along the length of the plurality of outwardly facing ribs with the greatest height at the front side and decreasing to no height at the back side;

a plurality of inwardly facing ribs positioned on the exterior surface of the second side having a rectangular shape;

the interior surface of the first side is smooth and does not contain outwardly facing ribs and the interior surface of the second side is smooth and does not contain inwardly facing ribs; and wherein the interior surface of the first side is a continuous circular surface that extends from the top portion to the first planar portion, and wherein the interior surface of the second side is a continuous circular surface that extends from the top portion to the second planar portion.

2. The surround device according to claim 1, wherein the notches are u-shaped.

3. The surround device according to claim 1, wherein the ribs have a length of between about 70 mm and about 1 mm and a width between about 40 mm and about 1 mm.

4. The surround device according to claim 1, wherein the ribs have a length of between about 50 mm and about 10 mm and a width of between about 20 mm and about 5 mm.

5. The surround device according to claim 1, wherein the ribs have a length of between about 30 mm to about 20 mm and a width of about 15 mm to about 10 mm.

6. The surround device according to claim 1, wherein the first planar portion extends outwardly and forms an angle between an exterior surface of the first planar portion and an exterior surface of the first side of about 90° to about 120°.

7. The surround device according to claim 1, wherein the second planar portion extends outwardly and forms an angle between an interior surface of the second planar portion and a plane extending horizontally under the surround device of about 95° to about 150°.

8. A surround device of a speaker comprising:

a top portion having an interior surface and an exterior surface;

a first side extending downwardly from the top portion having an interior surface and an exterior surface;

a second side extending downwardly from the top portion and opposite the direction of the first side having an interior surface and an exterior surface, wherein the second side is continuous and serves as an inside portion of the surround device;

a trough formed within the interior surfaces of the first side, second side, and top portion;

a first planar portion that extends outwardly from the first side to an outer edge;

a second planar portion that extends outwardly from the second side to an outer edge;

a plurality of outwardly facing ribs positioned on the exterior surface of the first side that is continuous, serving as an outside portion of the surround device and spans the plurality of outwardly facing ribs, the outwardly facing ribs have a rectangular shape and a front side and a back side, the front side adjacent the first planar portion, the height of the plurality of outwardly facing ribs decreases from the front side to the back side, the decrease in height is gradual along the length of the plurality of outwardly facing ribs with the greatest height at the front side and decreasing to no height at the back side;

a plurality of inwardly facing ribs positioned on the exterior surface of the second side that is continuous, serving as an outside portion of the surround device and spans the plurality of inwardly facing ribs, the inwardly facing ribs have a rectangular shape and the interior surfaces of the first side and second side do not contain inwardly facing ribs or outwardly facing ribs and the inwardly facing ribs and outwardly facing ribs do not extend into the trough; and wherein the interior surface of the first side is a continuous circular surface that extends from the top portion to the first planar portion, and wherein the interior surface of the second side is a continuous circular surface that extends from the top portion to the second planar portion.

9. The surround device according to claim 8, wherein the outwardly facing ribs are spaced-apart an equal distance along an exterior side of the first side.

10. The surround device according to claim 8, wherein the inwardly facing ribs are spaced-apart an equal distance along an exterior side of the second side.

11. The surround device according to claim 8, wherein the plurality of outwardly facing ribs have a front side and a back side, the width of the plurality of outwardly facing ribs decreases along the length of the plurality of outwardly facing ribs from the front side to the back side.

12. The surround device according to claim 8, wherein the plurality of inwardly facing ribs have a front side and a back side, the width of the plurality of inwardly facing ribs gradually increases along the length from the front side to a central portion of the plurality of inwardly facing ribs and then gradually decreases along the length from the central portion to the back side.

13. A circular surround device of a speaker comprising:

a top portion having an interior surface and an exterior surface;

a first side extending downwardly from the top portion and having an interior side and an exterior side and having an interior surface and an exterior surface;

a second side extending downwardly from the top portion and opposite the direction of the first side and having an interior side and an exterior side and having an interior surface and an exterior surface;

a trough formed within the interior surfaces of the first side, the second side, and the top portion;

a first planar portion that extends outwardly from the first side to an outer edge and contains at least four groupings of notches, wherein each grouping of the at least one grouping consists of three spaced-apart notches, within the outer edge;

a second planar portion that extends outwardly from the second side to an outer edge;

a plurality of outwardly facing ribs positioned on the exterior surface of the first side having a rectangular shape and a front side and a back side, the front side adjacent the first planar portion, the height of the plurality of outwardly facing ribs decreases from the front side to the back side, the decrease in height is gradual along the length of the plurality of outwardly facing ribs with the greatest height at the front side and decreasing to no height at the back side;

a plurality of inwardly facing ribs positioned on the exterior surface of the second side and having a rectangular shape and the interior surfaces of the first side and second side are flat and do not contain inwardly facing ribs or outwardly facing ribs and the inwardly facing ribs and outwardly facing ribs do not extend into the trough; and wherein the interior surface of the first side is a continuous circular surface that extends from the top portion to the first planar portion, and wherein the interior surface of the second side is a continuous circular surface that extends from the top portion to the second planar portion.

14. The circular surround device according to claim 13, further comprising at least eight groupings of notches.

15. The circular surround device according to claim 13, wherein the top portion does not contain any ribs for creating a linear displacement range.

16. The circular surround device according to claim 13, wherein a front side of the plurality of outwardly facing ribs are disposed on the first planar portion.

17. The circular surround device according to claim 13, wherein the plurality of outwardly facing ribs have a width of between about 12 mm to about 14 mm.

18. The circular surround device according to claim 13, wherein the plurality of inwardly facing ribs have a width of between about 12 mm to about 15 mm.

* * * * *